United States Patent [19]

Miyano et al.

[11] Patent Number: 4,599,981

[45] Date of Patent: Jul. 15, 1986

[54] METHOD OF CONTROLLING AIR-FUEL RATIO OF AN ENGINE

[75] Inventors: Takashi Miyano; Shunji Takahashi, both of Oi, Japan

[73] Assignee: Mikuni Kogyo Kabushiki Kaisha, Tokyo, Japan

[21] Appl. No.: 671,321

[22] Filed: Nov. 14, 1984

[30] Foreign Application Priority Data

Nov. 15, 1983 [JP] Japan ..... 58-213397

[51] Int. Cl.[4] ..... F02D 9/02

[52] U.S. Cl. ..... 123/361; 123/399

[58] Field of Search ..... 123/344, 352, 361, 399, 123/440, 445, 472, 478, 480, 489, 491; 364/431.05

[56] References Cited

U.S. PATENT DOCUMENTS 4,335,689 6/1982 Abe et al. ..... 123/399 X 4,367,708 1/1983 Nakamura et al. ..... 123/361 X 4,419,973 12/1983 Collonia ..... 123/361

4,501,240 2/1985 Aono ..... 123/589 X 4,519,361 5/1985 Murakami ..... 123/399

*Primary Examiner*—Willis R. Wolfe, Jr.

*Attorney, Agent, or Firm*—Owen, Wickersham & Erickson

[57] ABSTRACT

A method and device for controlling the air-fuel ratio of an internal combustion engine are disclosed. In this method and device the actuator for controlling the air-flow rate is selected as an actuator capable of causing change with passage of time frequently, and the deviation of air-fuel ratio is detected by an air-fuel sensor from a small air-flow rate point corresponding to, for example, an idling speed of engine and a large air-flow rate point corresponding to a predetermined engine speed during running thereby correcting the parameters a and b.

7 Claims, 3 Drawing Figures

METHOD OF CONTROLLING AIR-FUEL RATIO OF AN ENGINE

BACKGROUND OF THE INVENTION

The present invention relates to a method for controlling the air-fuel ratio of an internal combustion engine, and more particularly to a method for controlling the air-fuel ratio of an engine in which a proper air-fuel ratio may be obtained by detecting the deviation of the amount of air caused by a change with passage of time in the throttle valve actuator.

It is well known to provide an electronic fuel priority control system (engine automatic control) that determines an amount of fuel and an amount of air in accordance with operation of an accelerator pedal in such a manner that an engine is held in a proper running condition. In such a system, in order to obtain proper engine running condition, it is necessary to operate respective actuators for controlling the amount of fuel and air in the normal condition.

When, for example, carbon becomes attached to the respective actuators and the change with passage of time in the actuators is caused by deviation of a zero point detection switch, the respective actuators cannot perform their proper operation and thus the proper air-fuel ratio cannot be obtained.

SUMMARY OF THE INVENTION

It is an object of the present invention to overcome the above-described disadvantages of the conventional method.

It is another object of the present invention to provide, in a method for controlling the air-fuel ratio of an internal combustion engine, the capability of obtaining a proper air-fuel ratio even in the case where a change with passage of time is generated by the accelerator pedal actuator.

According to the present invention there is provided a method for controlling the air-fuel ratio of an internal combustion engine comprising the steps of: storing a relation between a throttle valve opening and an air-flow rate in a memory as a fundamental characteristic; detecting the air-fuel ratio of the engine during its operation by a sensor for the air-fuel ratio provided on the engine; deriving deviations between values of the air flow rate at given small and large air-flow rate points and values of air-flow rate at corresponding points from the detected air-fuel ratio and the fundamental characteristic, respectively; calculating an offset amount to the fundamental characteristic from the deviation at a small flow rate point; calculating an inclined angle to the fundamental characteristic from the deviation at a large flow rate point; and correcting and controlling an operating amount of the throttle valve actuator by the offset amount and the inclined angle as a correction factor.

These and other features and advantages of the present invention will become readily apparent from the following detailed description of one embodiment of the present invention, particularly when taken in connection with the accompanying drawings.

DETAILED DESCRIPTION OF THE EMBODIMENT

Figure 1:
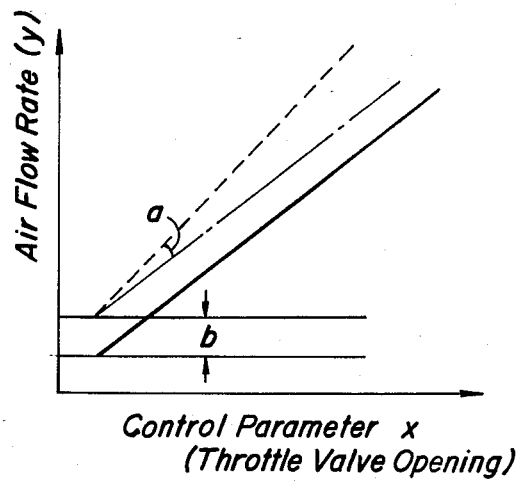
FIG. 1 is a characteristic view showing a relation between air-flow rate and a throttle valve opening.

Referring now to the drawings, there is shown one embodiment of a method of controlling the air-fuel ratio of an internal combustion engine according to the present invention.

A characteristic between air-flow rate and a throttle valve opening is shown in FIG. 1, in which a throttle valve opening x as a control parameter is plotted as abscissa and an air-flow rate y in accordance with the throttle valve opening is plotted as ordinate. As shown in FIG. 1 a fundamental characteristic shown by a relation between the air-flow rate and the throttle valve opening is designated by a solid line. By a change with passage of time this fundamental characteristic is changed in parallel with an offset amount (b), as shown by a dot-dash line, or changed by an inclined angle (a) and the offset amount (b), as shown by a dotted line. The fundamental characteristic, shown by the solid line, is represented by a function of $y=f(x)$, the characteristic shown by the dot-dash line can be represented by a function of $y=F(x)+b$ and the characteristic shown by the dotted line can be represented by a function of $y=af(x)+b$. These characteristic equations are approximations so that the characteristic can be corrected by the offset amount b and the angular deviation a.

According to the present invention the actuator for controlling the air-flow rate is selected as an actuator capable of causing change with passage of time frequently, and the deviation of the air-fuel ratio is detected by an air-fuel sensor from a small air-flow rate point corresponding to, for example, an idling speed of the engine and a large air-flow rate point corresponding to an increased engine speed during running at, for example, 100 km/h thereby correcting the parameters a, b.

Figure 2:
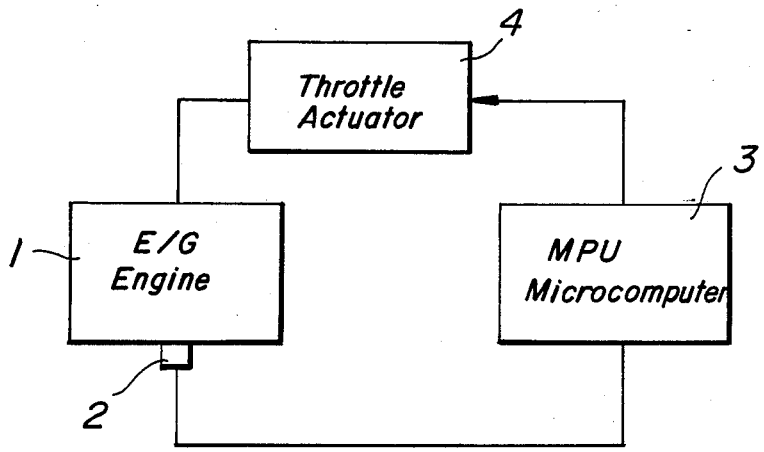
FIG. 2 is a block diagram showing one embodiment of the device for carrying out a method of controlling the air-fuel ratio of an engine according to the present invention.

FIG. 2 shows a device for carrying out a method of controlling the air-fuel ratio of an engine according to the present invention. In FIG. 2 reference numeral 1 denotes an internal combustion engine which detects the air-fuel ratio during engine operation by an air-fuel ratio sensor 2 mounted to an exhaust pipe (not shown). The output signal corresponding to the detected air-fuel ratio of the sensor 2 is supplied to a microcomputer 3 (herein after referred to as MPU) and monitored therein.

The MPU 3 stores various values corresponding to the fundamental characteristic $y=f(x)$ between the throttle valve opening and the air-flow rate at normal operation, and it calculates a correction factor to be described later from the stored contents and the detected values of the sensor 2. The output of MPU 3 is supplied to a throttle actuator 4, thereby correcting the characteristic of the air-fuel ratio.

The sensor 2 may detect an oxygen amount in the exhaust pipe by using an oxygen sensor, or it may detect a throttle valve opening.

The means for obtaining a required air-fuel ratio by the detected output of the sensor 2 is as follows:

At first, the required air-fuel ratio may be corrected by the following equation (1) at a small air-flow rate detection point.

$$QA_m = QA + \text{(offset amount)} \quad (1)$$

wherein $QA_M$ is the actually required amount of air.

QA is an amount of air calculated by the fundamental air-flow rate characteristic.

The offset amount is an amount determined by the output of air-fuel ratio sensor.

The required air-fuel ratio may be corrected by following equations (2) or (3) at a large air-flow rate detection point.

$$QA_M = QA \times A \quad (2)$$

$$\theta THOUT = \theta TH + \theta(\text{offset}) \quad (3)$$

wherein $\theta$THOUT is the throttle valve angle for obtaining the actual required amount of air.

$\theta$TH is the throttle valve angle calculated by the fundamental air-flow rate characteristic.

$\theta$(offset) and A are values determined by the output of the air-fuel ratio sensor.

Actually, according to the present invention the offset amount corresponding to the parameter b in the equation $y=f(x)+b$ is learned at a small air-flow rate detection point and the inclined angle corresponding to the parameter a in the equation $y=af(x)+b$, is learned at a large air-flow rate detection point, thereby calculating the respective correction amount.

Figure 3:
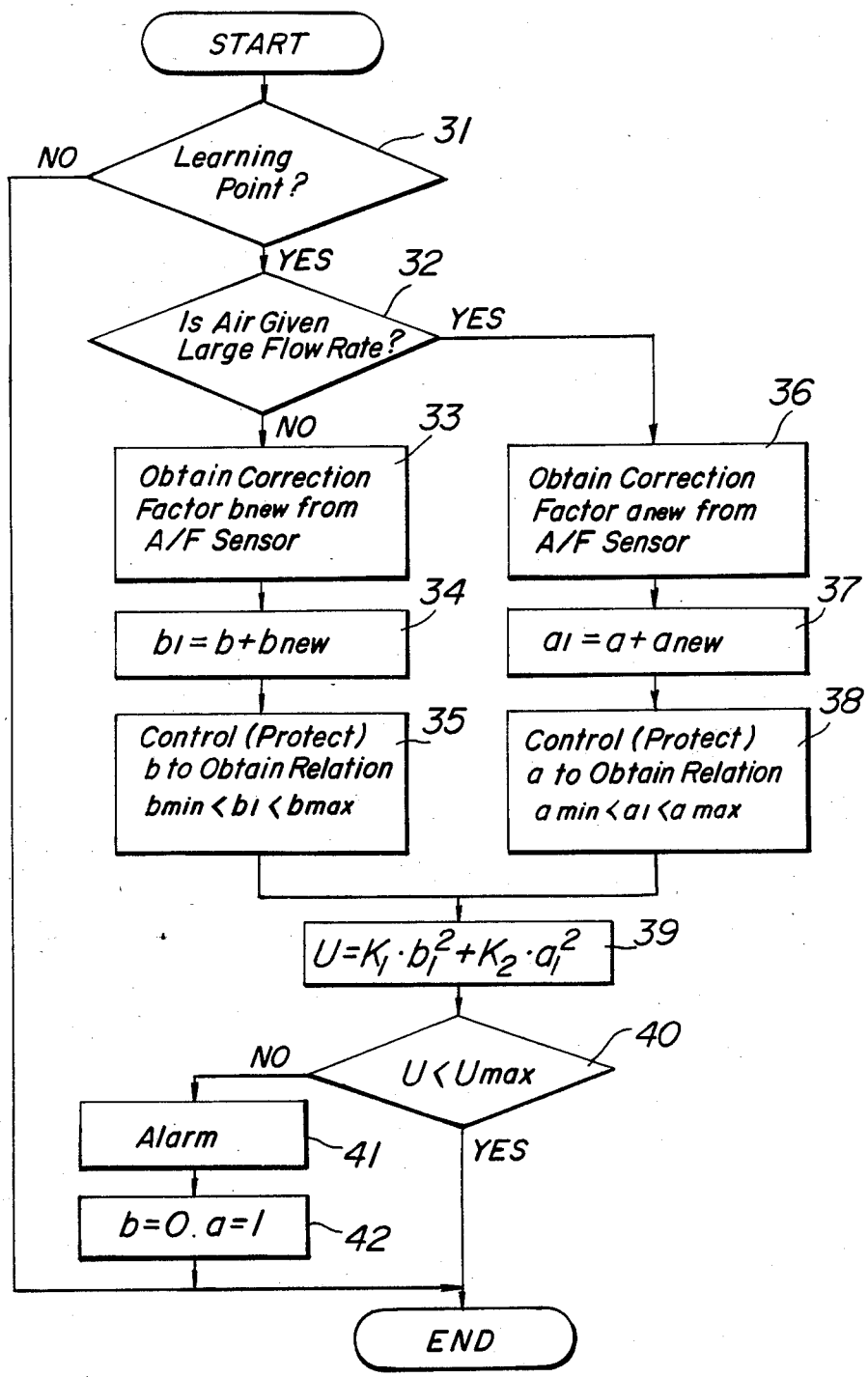
FIG. 3 is a flow chart explaining the operation step of an arithmetic unit shown in FIG. 2.

Operation of the MPU 3 is described with reference to the flow chart of FIG. 3. Start is carried out in synchronism with a rotational speed of the engine 1. At first, a step 31 decides whether or not an input is a predetermined learning point, i.e., either as the small air-flow rate detection point or the large air-flow rate detection point. When it is at the predetermined learning point (YES), a step 32 decides whether or not the content is at a predetermined large air-flow rate detection point (for example, 100 km/h) or not. As monitor points for the sensor 2 there are only two typical points of engine speed, that is, the idling speed and engine speed during running at 100 km/h. When the content of the step 32 is not at a large air-flow rate detection point (NO), it is at idle, and a step 33 calculates a correction factor "b new" of the parameter b according to the detected output of the sensor 2. That is, a deviation is obtained as the difference between the amount of air previously set as a fundamental characteristic and the amount of air detected by the sensor 2. This deviation is converted to a current amount of air, thereby obtaining an offset amount. A step 34 obtains an offset amount $b_1$ with an addition of the calculated correction amount (b+b new) and then a step 35 controls the offset amount in such a manner that it is present within a predetermined range. For example, so that $b_1$ is greater than a minimum amount $b_{min}$ and less than a maximum amount $b_{max}$. That is, this is a kind of a protection means.

When the content of the step 32 is at a predetermined large air-flow rate detection point (YES), a step 36 obtains a correction factor "a new" of the inclined angle amount, according to the detected output value of the sensor 2. Steps 37 and 38 perform the same type of operation as that of steps 34 and 35, as shown in FIG. 3. Step 39 obtains an evaluation function U by using respective of the correction amounts $a_1$ and $b_1$. Step 40 decides a differential amount between the calculated evaluation function U and a given value $U_{max}$. When the evaluation function U is larger than the given value $U_{max}$ a step 41 generates an alarm, and a step 42 marks a respective correction factor $b_1=0$ and $a_1=1$ thereby re-obtaining the fundamental characteristic. When the content of the step 31 is not the learning point (NO), operation of MPU 3 is stopped and after a given time delay, the above operation of MPU 3 is again started.

As described above, according to the present invention a proper control of air-fuel ratio can be obtained by always correcting the deviation amount with a calculation of correction amount.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. In an engine control system, a device for controlling air-fuel ratio of an internal combustion engine having a throttle valve with an actuator, comprising:

means for storing a relation between a throttle valve opening on the engine and air-flow rate in a memory as a fundamental characteristic;

sensor means on the engine for detecting the air-fuel ratio of the engine during its running operation;

means for deriving deviations between values of air-flow rate at given small and large air-flow rate points and values of air-flow rate at corresponding points from the detected air-fuel ratio and the fundamental characteristic respectively;

means for calculating an offset amount relative to the fundamental characteristic from the deviation at the small flow rate point;

means for calculating an inclined angle relative to the fundamental characteristic from the deviation at the large flow rate point; and means for correcting and controlling an operating amount of the throttle valve actuator by said offset amount and said inclined angle as correction factors.

2. The device for controlling the air-fuel ratio of an engine as claimed in claim 1, wherein the fundamental characteristic is represented in a microcomputer by a function of $y=f(x)$ and the characteristic to be corrected is approximated by a function of $y=a(x)+b$.

3. A method for controlling air-fuel ratio of an internal combustion engine having a throttle valve with an actuator, comprising the steps of:

storing a relation between a throttle valve opening and air-flow rate in a memory as a fundamental characteristic;

detecting the air-fuel ratio of the engine during running operation by a sensor for air-fuel ratio provided with the engine;

deriving deviations between values of air-flow rate at given small and large air-flow rate points and values of air-flow rate at corresponding points from the detected air-fuel ratio and the fundamental characteristic respectively;

calculating an offset amount relative to the fundamental characteristic from the deviation at the small air-flow rate point;

calculating an inclined angle relative to the fundamental characteristic from the deviation at the large air-flow rate point; and correcting and controlling an operating amount of the throttle valve actuator by said offset amount and said inclined angle as correction factors.

4. A method for controlling the air-fuel ratio of an engine as claimed in claim 3 wherein the air-fuel sensor is an oxygen sensor.

5. A method for controlling the air-fuel ratio of an engine as claimed in claim 3, wherein the fundamental characteristic is represented by a function of $y=f(x)$ and the characteristic as corrected is approximated by a function of $y=a(x)+b$.

6. A method for controlling the air-fuel ratio of an engine as claimed in claim 5, wherein b of the approximation is the offset amount at the small point and a is the approximation of the inclined angle at the large point.

7. A method for controlling the air-fuel ratio of an engine as claimed in claim 6, wherein the small air-flow rate point corresponds to an idling speed of the engine and the large air-flow rate point corresponds to an engine speed during running at 100 km/h.

* * * * *